US006995726B1

(12) United States Patent
West et al.

(10) Patent No.: US 6,995,726 B1
(45) Date of Patent: Feb. 7, 2006

(54) SPLIT WAVEGUIDE PHASED ARRAY ANTENNA WITH INTEGRATED BIAS ASSEMBLY

(75) Inventors: James B. West, Cedar Rapids, IA (US); John C. Mather, Cedar Rapids, IA (US)

(73) Assignee: Rockwell Collins, Cedar Rapids, IA (US)

( * ) Notice: Subject to any disclaimer, the term of this patent is extended or adjusted under 35 U.S.C. 154(b) by 5 days.

(21) Appl. No.: 10/891,724

(22) Filed: Jul. 15, 2004

(51) Int. Cl.
*H01Q 13/00* (2006.01)

(52) U.S. Cl. ..... 343/776; 343/778

(58) Field of Classification Search ..... 343/762, 343/772, 776, 778
See application file for complete search history.

(56) References Cited

U.S. PATENT DOCUMENTS

| | | | | |
|---|---|---|---|---|
| 5,170,140 | A | 12/1992 | Lowe et al. | |
| 5,198,828 | A * | 3/1993 | West et al. | 343/776 |
| 5,309,165 | A | 5/1994 | Segal et al. | |
| 5,309,166 | A | 5/1994 | Collier et al. | |
| 5,426,403 | A | 6/1995 | LaLau et al. | |
| 5,786,792 | A | 7/1998 | Bellus et al. | |
| 5,845,391 | A | 12/1998 | Bellus et al. | |
| 5,886,671 | A * | 3/1999 | Riemer et al. | 343/776 |
| 5,977,930 | A * | 11/1999 | Fischer et al. | 343/853 |
| 6,115,002 | A * | 9/2000 | Fischer et al. | 343/770 |
| 6,437,754 | B2 * | 8/2002 | Yuanzhu | 343/786 |
| 6,552,691 | B2 | 4/2003 | Mohuchy et al. | |
| 6,650,291 | B1 | 11/2003 | West et al. | |

OTHER PUBLICATIONS

*Antenna Engineering Handbook*, Johnson and Jasik Eds., Chapter 9, *Slot-Array Antennas*, Hung Yuet Yee, pp. 9-1 through 9-37, McGraw-Hill, NY, NY, 1984.

"Wideband Vivaldi Arrays for Large Aperture Antennas" by D. H. Schaubert et al. Perspectives on Radio Astronomy-Technology for Large Antenna Arrays, Netherlands Foundation for Research in Astronomy, 1999.

"Characteristics of Ka Band Waveguide Using Electromagnetic Crystal Sidewalls", by J. A. Higgins et al., 2002 IEEE MTT-S International Microwave Symposium, Seattle, WA, Jun. 2002.

Hansen, R.C., *Phased Array Antennas*, John Wiley and Sons, Inc., NY, NY, 1999, pp 20-25, 164-201.

Sikora, L., and Womack, J., "The Art and Science of Manufacturing Waveguide Slot-Array Antennas," *Microwave Journal*, Jun., 1988, pp. 157-162.

Patent Application for "A Construction Approach for an EMXT-Based Phased Array Antenna", by John C. Mather et al., U.S. Appl. No. 10/273,872, Oct. 18, 2002.

Patent Application for "A Method and Structure for Phased Array Antenna Interconnect", by John C. Mather et al., U.S. Appl. No. 10/273,459, filed Oct. 18, 2002.

* cited by examiner

*Primary Examiner*—Shih-Chao Chen
(74) *Attorney, Agent, or Firm*—Nathan O. Jensen; Kyle Eppele

(57) ABSTRACT

A phased array antenna is made up of linear arrays. Each of the linear arrays has a printed circuit board spine. Split waveguides are formed from two symmetrical portions conductively joined to ground on opposite sides of the printed circuit board spine. Planar transmission line-to-waveguide transitions are mounted on the printed circuit board spine within the split waveguides. Phase shifter/TTD devices are mounted on the circuit board spine within the split waveguides for steering the phased array antenna beam. Bias and control circuitry is etched on the circuit board spine for biasing and controlling the phase shifter/TTD devices. The phased array antenna may be made up of the linear arrays combined into a two-dimensional array and fed with a waveguide feed or a printed feed manifold attached to the printed wiring board spine.

21 Claims, 11 Drawing Sheets

SPLIT WAVEGUIDE PHASED ARRAY ANTENNA WITH INTEGRATED BIAS ASSEMBLY

CROSS REFERENCE TO RELATED APPLICATIONS

The present application is related to co-pending application Ser. No. 10/273,459 filed on Oct. 18, 2002 entitled "A Method and Structure for Phased Array Antenna Interconnect" invented by John C. Mather, Christina M. Conway, and James B. West and to Ser. No. 10/273,872 entitled "A Construction Approach for an EMXT-Based Phased Array Antenna" invented by John C. Mather, Christina M. Conway, James B. West, Gary E. Lehtola, and Joel M. Wichgers. The co-pending applications are incorporated by reference herein in their entirety. All applications are assigned to the assignee of the present application.

BACKGROUND OF THE INVENTION

This invention relates to antennas, phased array antennas, and specifically to a phased array antenna utilizing planar phase shifter or true time delay (TTD) devices and a structure for embedded control and bias lines.

Phased array antennas offer significant system enhancements for both military and commercial SATCOM and radar systems. In the military scenario it is crucial to maintain near total situational awareness and a battle brigade must have reliable satellite communications in a moving platform environment. Maintaining connectivity in these environments is critical to future systems such as the Future Combat Systems (FCS) and other millimeter wave SATCOM and radar systems. The application of these technologies to satellite communication subsystems will provide high-directionality beams needed to close the link with reasonably sized power amplifiers and will provide excellent anti-jam (A/J) and low probability of detection and interception (LPD/LPI) performance.

It is well known within the art that the operation of a phased array is approximated to the first order as the product of the array factor and the radiation element pattern as shown in Equation 1 for a linear one-dimensional array. A similar expression to Equation 1 exists for a two-dimensional array 10 arranged in a prescribed grid as shown in FIG. 1.

$$E_A(\theta) \equiv \underbrace{E_p(\theta,\phi)}_{\text{Radiation Element Pattern}} \underbrace{\left[\frac{\exp\left(-j\frac{2\pi r_o}{\lambda}\right)}{r_o}\right]}_{\text{Isotropic Element Pattern}} \cdot \underbrace{\sum_N A_n \exp\left[-j\frac{2\pi}{\lambda} n\Delta x(\sin\theta - \sin\theta_o)\right]}_{\text{Array Factor}} \qquad \text{Equation 1}$$

Standard spherical coordinates are used in Equation 1 and θ is the scan angle referenced to bore sight of the array. Introducing phase shift at all radiating elements 15 within the array 10 changes the argument of the array factor exponential term, which in turns steers the main beam from its nominal position. Phase shifters are RF devices or circuits that provide the required variation in electrical phase. Array element spacing, Δx or Δy of FIG. 1, is related to the operating wavelength and sets the scan performance of the array 10.

To prevent beam squinting as a function of frequency, broadband phased arrays utilize true time delay (TTD) devices rather than traditional phase shifters to steer the antenna beam. Expressions similar to Equation 1 for the one- and two-dimensional TTD beam steering case are readily available in the literature.

Conventional waveguide phased array technology in which planar microwave/millimeter wave circuitry is used to implement phase shifting or true time delay (TTD) circuits is illustrated in FIG. 2. A basic unit cell 20 features a microstrip, coplanar waveguide or slot line transition for a rectangular waveguide 21 designed to operate in the fundamental $TE_{10}$ mode in FIG. 2. A planar circuit board to waveguide transition 22 is typically located in the center of the waveguide 21 where the electric field (E field) strength is at its maximum to facilitate coupling between the waveguide 21 and the planar circuit to waveguide transition 22. A packaged phase shifter or TTD device 25 is located on the planar circuit to waveguide transition 22. Several phase shifter architectures as well as TTD devices compatible with planar RF circuits can be used in this architecture, as shown in the table below. The table is a non-exhaustive list of TTD and of phase shifter devices 25 that may be used in the unit cell 20 of FIG. 2.

| Technology | Active Device | Circuit Architecture |
|---|---|---|
| TTD | MEMs | Switched Line |
| TTD | MMIC Semiconductor | Vector Modulator |
| Optical TTD | Future Technology | TBD |
| Phase Shifter | MMIC Semiconductor/PIN diode, Ferrite Microstrip | Switched Line, Loaded Line, High Pass, Low Pass, Reflective Hybrid |

The traditional waveguide-to-printed circuit transition approach shown in FIG. 2 has several shortcomings. There must be a robust, continuous RF ground connection between the planar circuit board 22 and the waveguide 21 broad wall to ensure low loss and consistent RF performance. This is very difficult to accomplish with conventional extruded waveguide technology since the circuit board 22 is somehow slid inside and secured to the waveguide 21. It is difficult to bring in control lines for the phase shifter/TTD device 25 from the exterior of the waveguide 21 without affecting RF performance. For large arrays, the assembly of this architecture is costly because many circuit boards 22 are individually mounted with one circuit board 22 in each radiating element waveguide 21. For large one-dimensional and two-dimensional phased array antenna assemblies, the routing and connection of bias control lines is very cumbersome.

What is needed is a cost-effective, low weight, high performance realization of one-dimensional and two-dimensional waveguide phased array antennas that utilize planar phase shifter or true time delay circuitry featuring embedded control and bias lines.

SUMMARY OF THE INVENTION

A phased array antenna with a steered beam comprises a plurality of split waveguide structures. The split waveguide structures further comprise printed circuit board substrates. Planar transmission line-to-waveguide transitions are disposed on the substrates. Split waveguides comprising two symmetrical portions are conductively joined to ground on opposite sides of the planar transmission line-to-waveguide transitions and the substrates. Phase shifter/TTD devices are mounted on the planar transmission line-to-waveguide transitions for steering the phased array antenna beam.

The phased array antenna further comprises a printed circuit board spine that is an extension of the substrates. A plurality of the planar transmission line-to-waveguide transitions, a plurality of split waveguides, and a plurality of phase shifter/TTD devices are mounted on the spine to form a linear array of split waveguide structures. The phased array antenna further comprises a plurality of the linear arrays of split waveguide structures that are combined into a two-dimensional array. Bias and control circuitry is etched on the printed circuit board spine for biasing and controlling the phase shifter/TTD devices within the split waveguide structures that are attached to the printed circuit board spine.

The phased array antenna may further comprise a slotted waveguide feed for feeding the linear array of split waveguide structures. In the two-dimensional array a plurality of slotted waveguide feeds may feed the plurality of linear arrays of split waveguide structures and a slotted waveguide feed manifold may feed the plurality of slotted waveguide feeds.

The phased array antenna may further comprise an integrated printed feed manifold printed on the printed wiring board spine for feeding the plurality of phase shifter/TTD elements. In a two-dimensional array a perpendicular feed manifold is connected to a plurality of integrated printed feed manifolds on the plurality of linear arrays of split waveguide feed structures to feed the two-dimensional array.

It is an object of the present invention to a provide cost effective, low-weight, high-performance one-dimensional and two-dimensional waveguide phased array antenna that utilizes phase shifter/TTD devices interconnected with embedded control and bias lines.

It is an object of the present invention to provide a split waveguide structure for use in a phased array antenna that has a planar transmission line-to-waveguide transition circuit board substrate with a robust ground connection to the waveguide.

It is an advantage of the present invention to provide a convenient mounting method for a phase shifter/TTD device on a circuit board substrate prior to attachment to waveguide half sections.

It is an advantage of the present invention to simplify interconnection of phase shifter/TTD devices in a large phased array.

It is a feature of the present invention to utilize routinely available printed circuit board fabrication processes and assembly methods.

It is a feature of the present invention to be able to utilize a variety of phased array feed techniques.

BRIEF DESCRIPTION OF THE DRAWINGS

The invention may be more fully understood by reading the following description of the preferred embodiments of the invention in conjunction with the appended drawings wherein.

DETAILED DESCRIPTION

The invention described herein greatly improves and expands on conventional waveguide phased array technology in which planar microwave/millimeter wave circuitry is used to implement phase shifting or true time delay (TTD) circuits.

Figure 1:
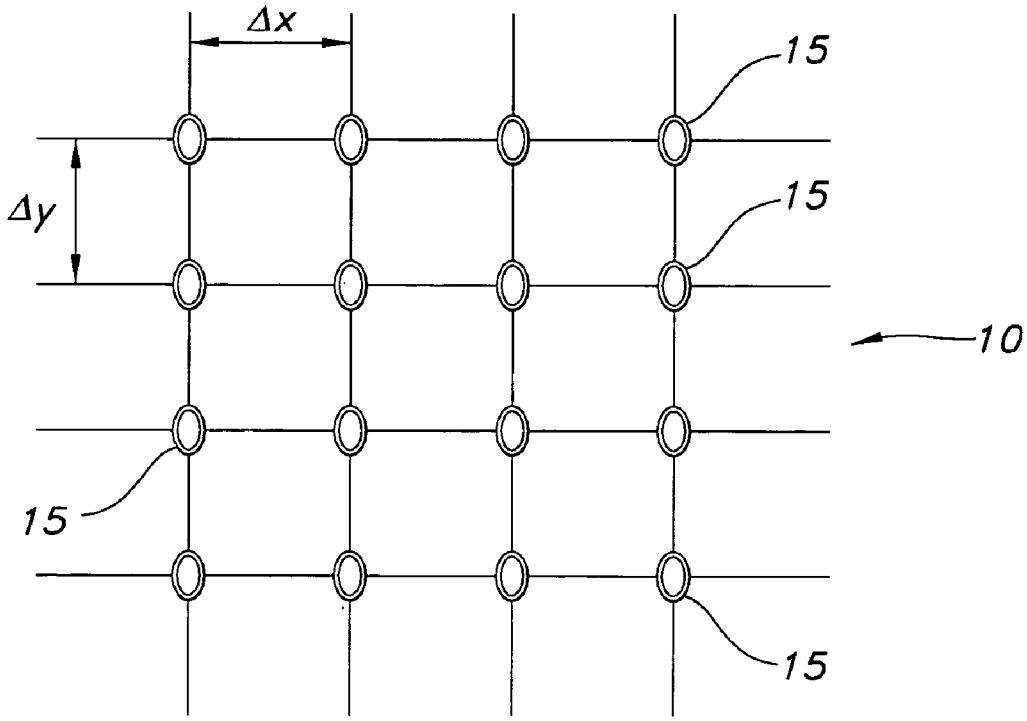
FIG. 1 (PRIOR ART)
FIG. 1 is a diagram of a rectangular two-dimensional planar phased array physical radiating element grid.
Figure 2:
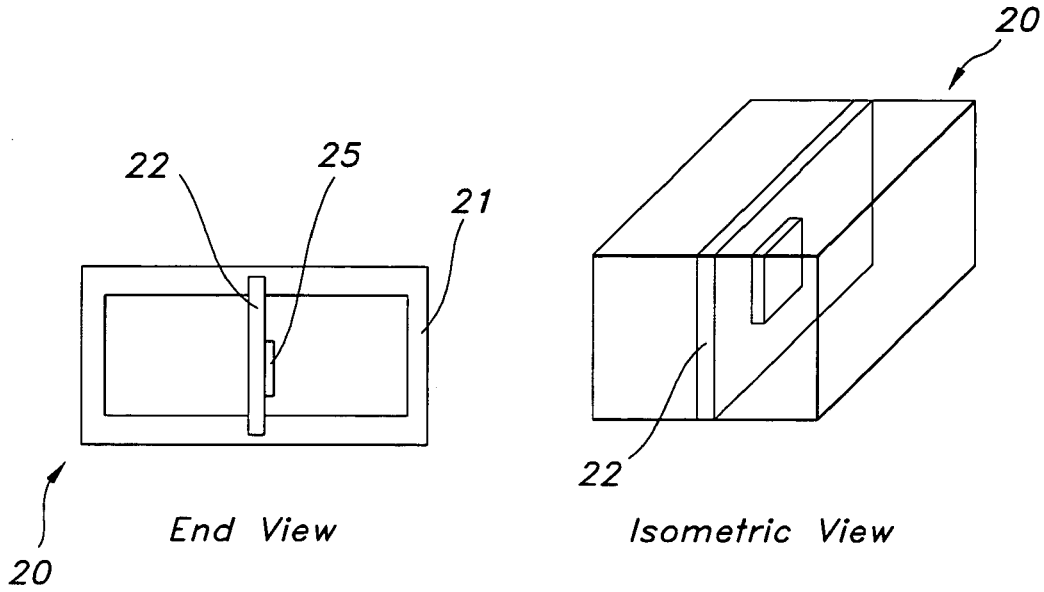
FIG. 2 (PRIOR ART)
FIG. 2 is a diagram of a waveguide with a planar phase shifter/TTD device as is currently practiced in the art.
Figure 3:
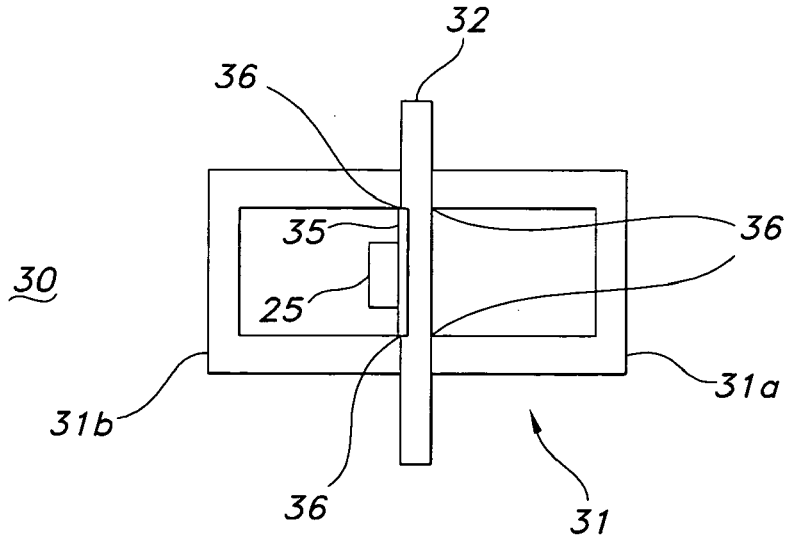
FIG. 3 is a diagram of a split waveguide and planar circuit phase shifter/TTD device assembly with the waveguide comprised of two symmetrical channels.

A split waveguide structure 30 of the present invention incorporating a planar transmission line-to-waveguide transition circuit board substrate 32 is illustrated in FIG. 3. A split waveguide 31 is comprised of two symmetrical waveguide portions, 31*a* and 31*b* with each portion having a channel or U-shaped cross section. Other shapes may be used that have at least one plane of symmetry. These two symmetrical waveguide portions 31*a* and 31*b* are conductively joined to a RF ground on opposite sides the circuit board substrate 32 at four low electrical resistance joints 36 between the circuit board substrate 32 and the symmetrical waveguide portions 31*a* and 31*b*. With this embodiment the RF planar circuit board substrate 32 and metallic split waveguide 31 have a robust ground connection. The phase shifter/TTD device 25 can be conveniently mounted to the circuit board substrate 32 prior to the attachment of the symmetrical waveguide portions 31*a* and 31*b*. The circuit board substrate 32 also contains a waveguide to microstrip or waveguide to stripline transition 35 shown in edge view in FIG. 3.

The symmetrical waveguide portions 31*a* and 31*b* may be realized using thin gauge sheet meal and precision forming methods. The symmetrical waveguide portions 31*a* and 31*b* are adequately rigid due to their geometry. Suitable surface finish, such as gold, silver, or the like to ensure low-loss waveguide radiating elements can be deposited on the sheet metal prior to forming the channel shape. Routinely available printed circuit fabrication processes and electronics assembly methods may be utilized and/or adapted to create the needed circuit elements and accomplish final integration and assembly.

The required robust electrical ground intersections of the symmetrical waveguide portions 31*a* and 31*b* and the substrate 32 within each split waveguide structure 30 can be achieved using a suitable low temperature metallurgical attachment process such as soldering, transient liquid phase (TLP) or liquid interface diffusion joining, the use of an amalgam, or the like. Spacing of vias through the substrate connecting symmetrical waveguide portions 31*a* and 31*b* must be much less than a wavelength.

Figure 4:
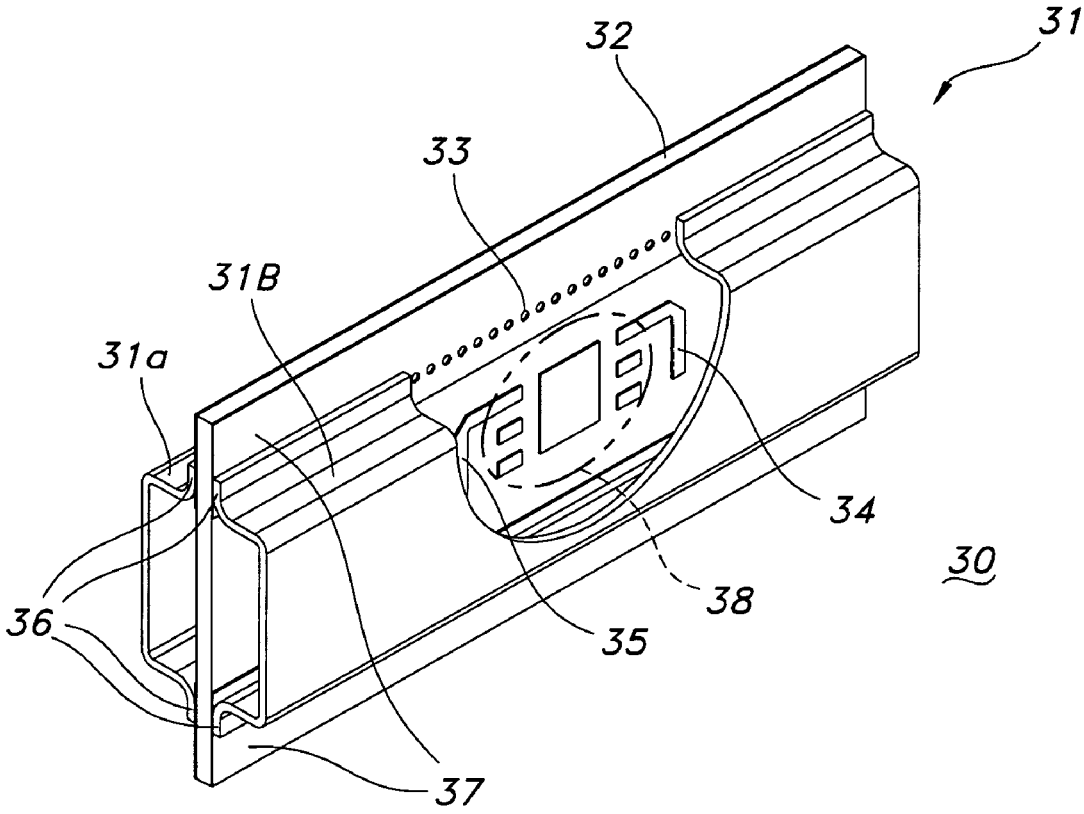
FIG. 4 is a detailed cut away view of the split waveguide structure of the present invention incorporating two symmetrical channels to form a split waveguide.

A detailed cut away view of the split waveguide structure 30 of the present invention is illustrated in FIG. 4. Each symmetrical waveguide portion 31*a* and 31*b* is metallurgically joined to substrate 32 ground metal 37. Closely spaced vias 33 through the substrate provide side-to-side ground continuity and complete the split waveguide 31. On the substrate 32 a mounting location 38 is provided for phase shifter/TTD device 25. Microstrip-to-waveguide transition circuitry 34, bias circuitry for phase shifter/TTD devices, and the waveguide transitions 35 may be etched on or embedded in the substrate 32 using multilayer interconnect technology.

A variety of waveguide cross section shapes and geometries may be used in this split construction approach of the present invention, such as rectangular, circular, triangular, ridge, etc. The only requirement is that the electric field of the waveguide transition be co-polarized with the waveguide electric field. This typically is in a plane of symmetry containing the centerline of the waveguide-to-planar printed wiring board substrate 32 transmission line.

The split waveguide structure 30 of the present invention is naturally suited for high purity, linearly polarized applications. It is possible to realize circular polarization my means of polarizing grids, such as a meander line or others known in the art.

Figure 5:
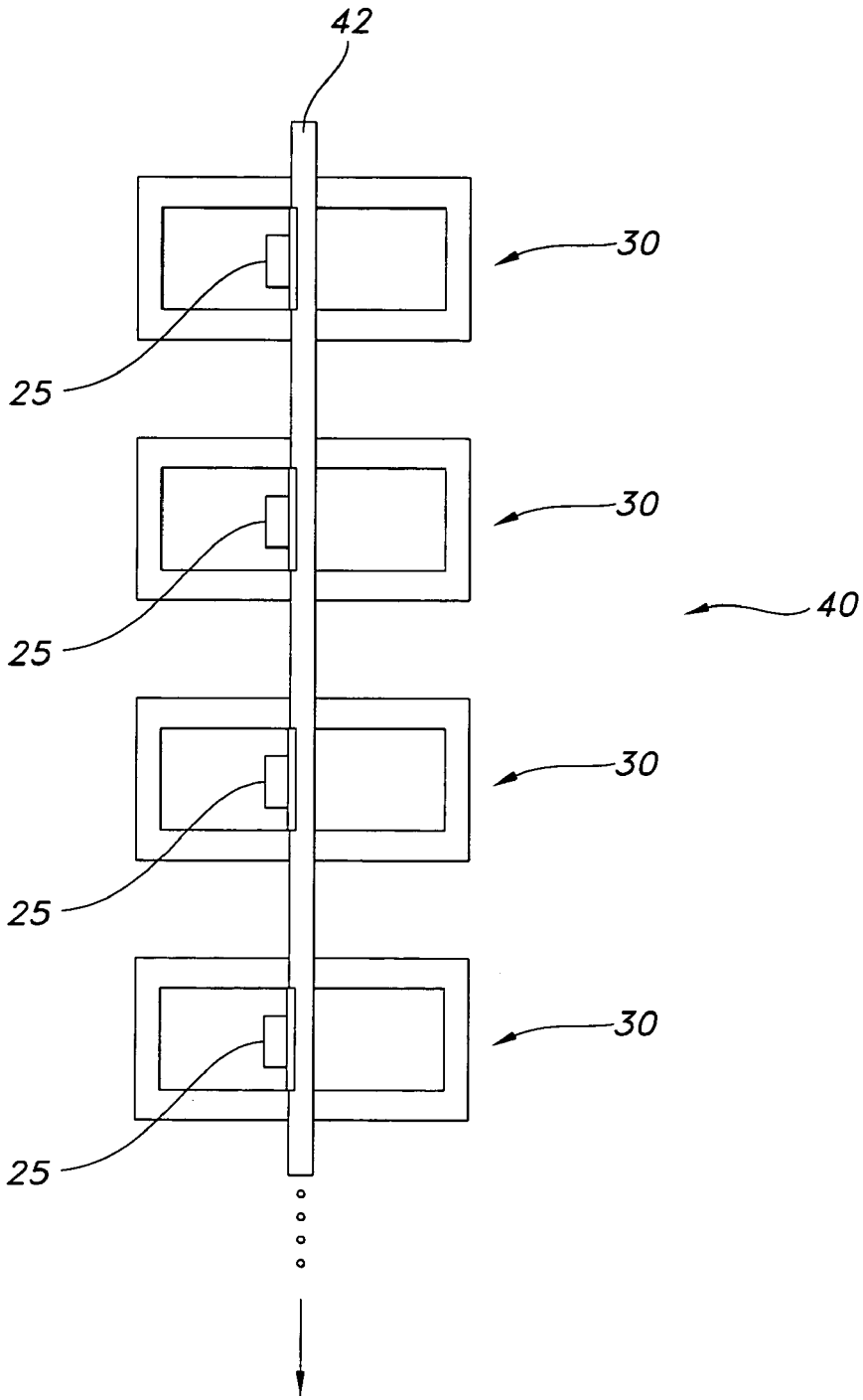
FIG. 5 is a diagram of a one-dimensional linear array having a printed circuit spine for mounting the split waveguide structures of FIG. 4.

The split waveguide structure 30 of the present invention is readily extended to create a linear array 40 for one-dimensional scanning, as illustrated in FIG. 5. A common printed wiring board (PWB) spine 42 runs through the center of several waveguide channel elements made up of the split waveguide structure 30. The spine 42 is an extension of the substrate 32. Bias and control circuitry for phase shifter/TTD devices 25 for each split waveguide structure 30 radiating element in the linear array 40 is realized using multilayer interconnect technology described in detail in the co-pending application Ser. No. 10/273,459 "A Method for Phased Array Antenna Interconnect". The control circuitry for each phase shifter/TTD device 25 can be embedded within the interconnect/PWB structure 42 and suitably interfaced to an outside controller (not shown).

The one-dimensional electronic scanning concept with the linear array 40 of FIG. 5 can be expanded to two-dimensional electronic scanning by assembling a two-dimensional array comprised of linear arrays 40. Both rectangular two-dimensional arrays 50 in FIG. 6 and hexagonal grid two-dimensional arrays 60 in FIG. 7 are possible. The hexagonal grid 60 has the feature of improved X plane grating lobe-free performance for a given array lattice space.

Figure 6:
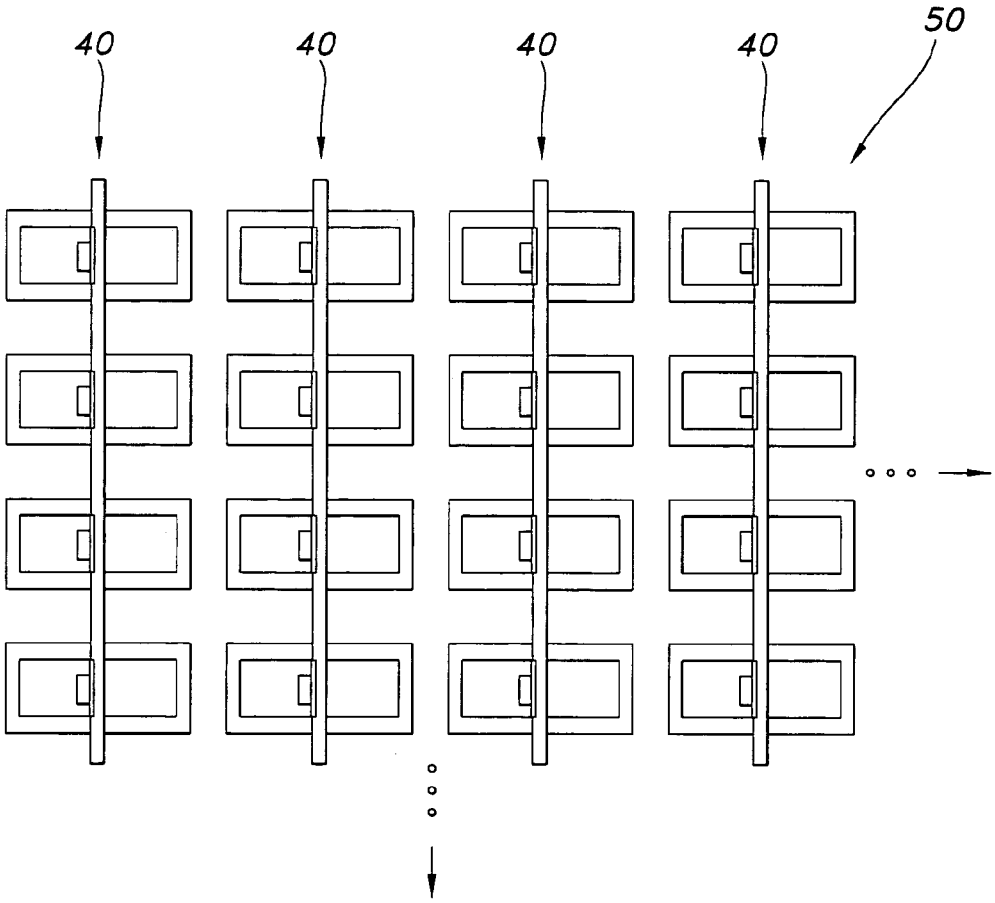
FIG. 6 is a diagram of a two-dimensional rectangular array using the one-dimensional linear array with the printed circuit spine of FIG. 5.
Figure 7:
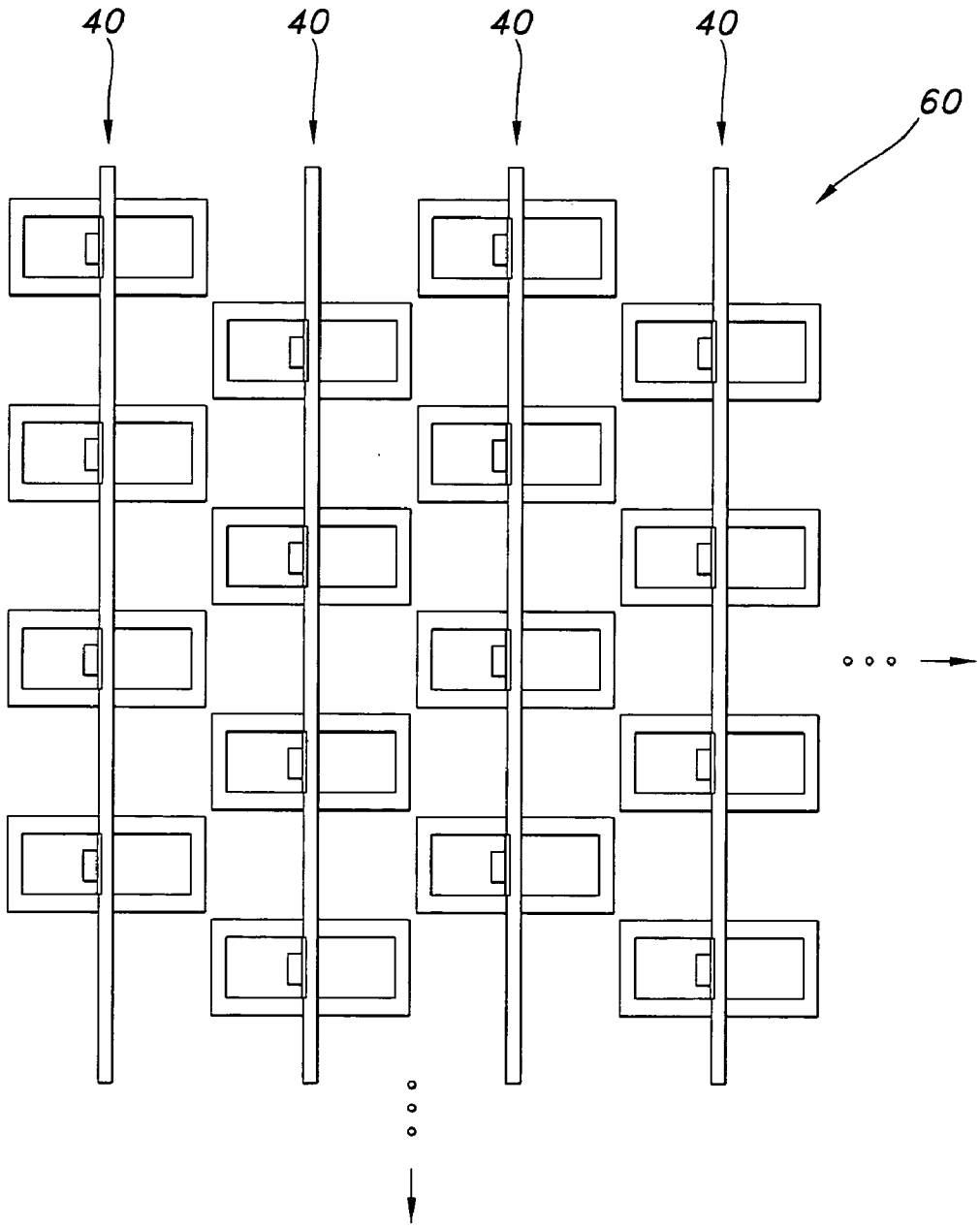
FIG. 7 is a diagram of a two-dimensional hexagonal grid array using the one-dimensional linear array with the printed circuit spine of FIG. 5.

The linear arrays 40 in two-dimensional arrays 50 and 60 of FIGS. 6 and 7 can be mechanically positioned and fastened at the ends of the linear arrays 40. Mechanical rigidity of the array interior is provided by the inherent mechanical stability of the spine printed wiring board 42 and the fastening of the linear arrays 40 to a feed assembly (not shown in FIGS. 6 and 7).

The one-dimensional linear array 40 and two-dimensional arrays 50 and 60 described herein can be fed in several ways, including waveguide constrained feed, printed constrained feed, horn semi-constrained space feed, and reflect array feed.

Waveguide constrained feed manifolds can be realized as binary corporate isolated feeds, and passive slotted waveguide arrays. The corporate isolated waveguide feed is very high performance, but has the disadvantages of high weight, large volume, and mechanical complexity. The slotted waveguide array is attractive because it can be fabricated as a stand-alone structure using conventional dip brazing and mature fabrication procedures.

Figure 8:
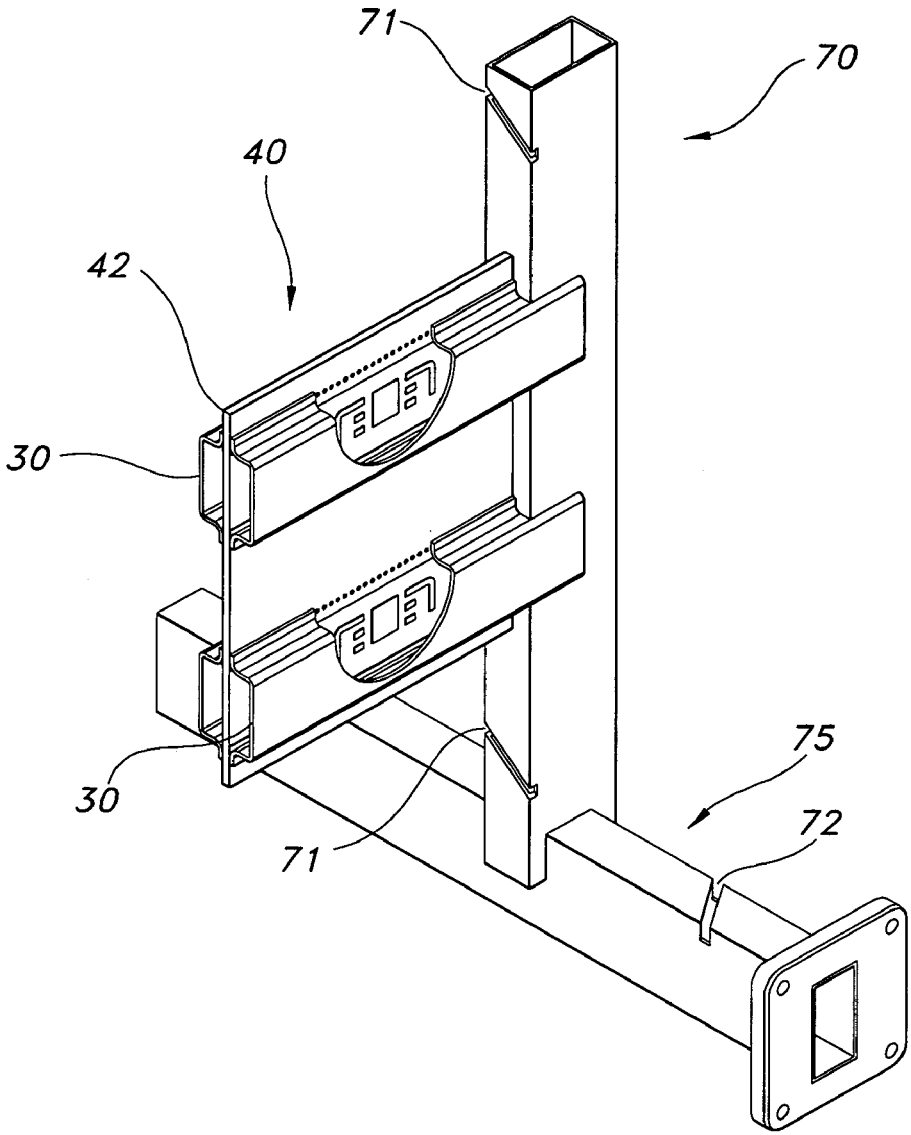
FIG. 8 shows a slotted waveguide feed that may be used to feed a phased array antenna utilizing the split waveguide structure of the present invention.

A slotted waveguide feed implementation is shown in FIG. 8. In FIG. 8 a slotted waveguide feed 70 is attached to the linear array 40 of FIG. 5. Linear array 40 comprises spine 42 that has disposed thereon split waveguide structures 30. The split waveguide structures 30 are connected to the slotted waveguide feed 70 and fed from slots 71 in slotted waveguide feed 70. The split waveguide feed 70 is end-fed from a slotted waveguide feed manifold 75 with slots 72. More than one linear array 40 and slotted waveguide feed manifold 70 may be incorporated in FIG. 8 to form the two-dimensional arrays 50 and 60 of FIGS. 5 and 6 respectively with the slotted waveguide feed implementation. It should be noted that other slotted waveguide feed embodiments are possible such as broad wall waveguide slots or slotted single ridge waveguide.

Figure 9:
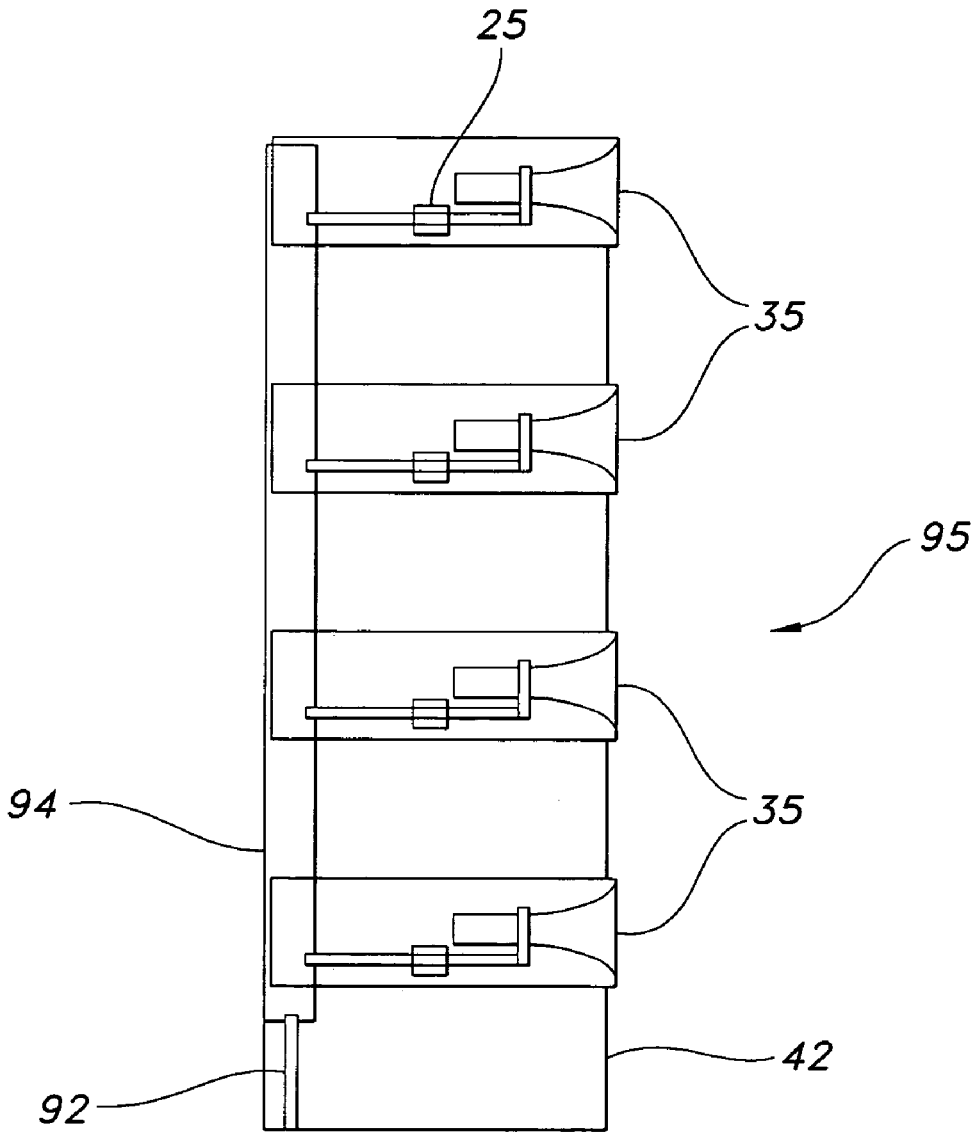
FIG. 9 shows a cross section of a waveguide linear array with a printed feed manifold on the spine.

RF printed wiring board constrained feeds can be etched on or embedded within the bias and control spine printed wiring board 42, as shown in FIG. 9. In FIG. 9, a linear array 95 (waveguides not shown) with integrated printed feed manifold 94 is shown in edge view. The phase shifter/TTD spine PWB 42 is shown with phase shifter/TTD devices 25 and waveguide transitions 35. The integrated printed feed manifold line 94 is printed on the spine PWB 42 and feeds the phase shifter/TTD devices 25 and transition elements 35 from linear array input 92.

Figure 10:
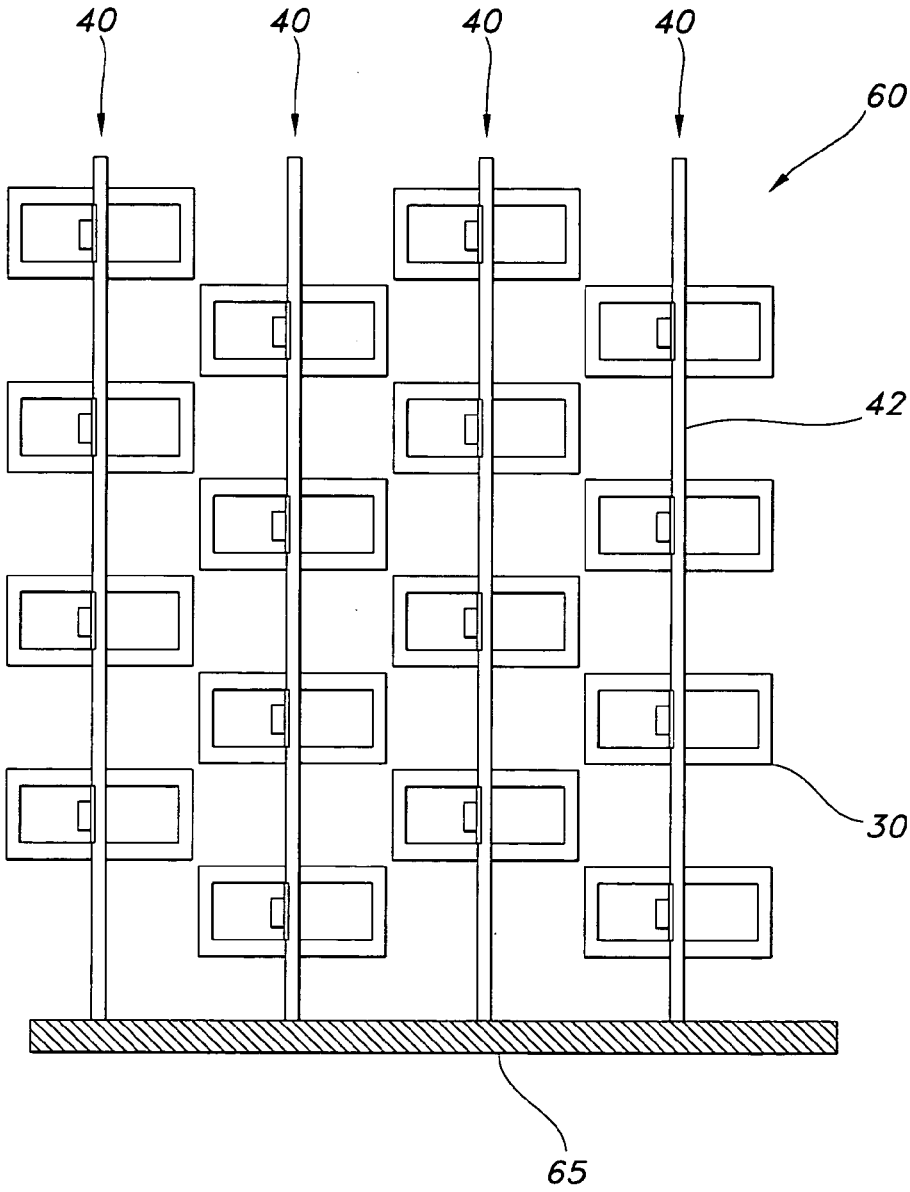
FIG. 10 shows the hexagonal two-dimensional array of FIG. 7 with a perpendicular feed manifold.

The two-dimensional arrays 50 and 60 using the printed feed manifold 94 and linear array input 92 of FIG. 9 may be fed by using a perpendicular feed manifold 65 attached on a perimeter of the hexagonal two-dimensional array 60 as shown in FIG. 10 and connected to the linear array inputs 92. The rectangular two-dimensional array 50 may be fed in a similar manner. The perpendicular feed manifold 65 can be printed transmission lines (microstrip, stripline, etc.) as commonly known in the art.

Figure 11:
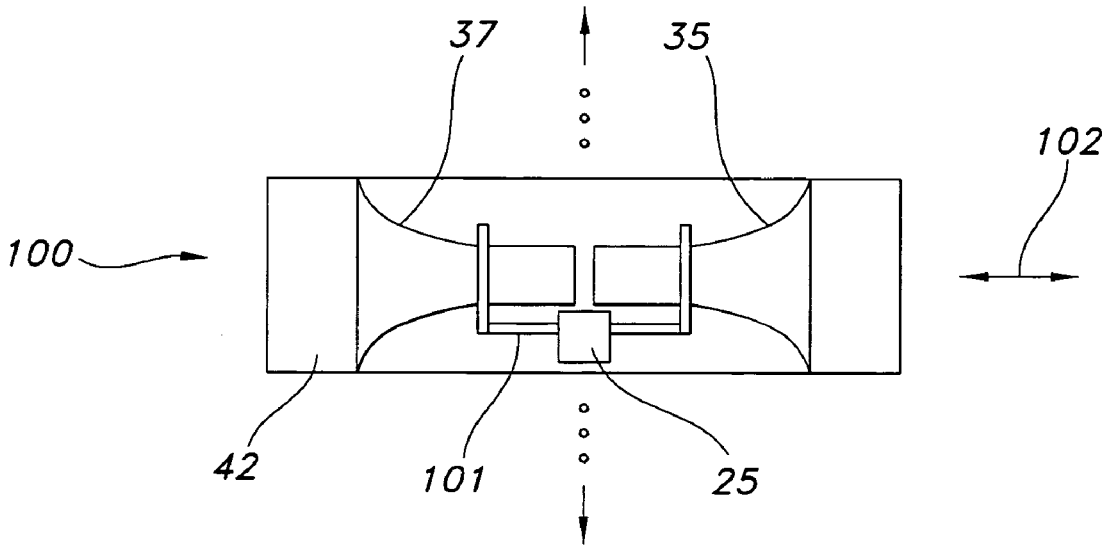
FIG. 11 shows a cross section of a unit cell with back-to-back radiating elements for use with a space feed.

A side view, without the symmetrical waveguide portions, of a split waveguide structure unit cell 100 of a space fed implementation is detailed in FIG. 11. The unit cell assembly 100 is a much simpler power combining approach relative to that of constrained feed shown in FIG. 9, at the expense of increased array depth. Back-to-back waveguide transitions 35 and 37 are used in this embodiment. A receive transition 37 accepts the incoming signal from a feed horn (not shown). Variable lengths of printed transmission lines 101 within the space unit cell 100 collimate an incoming wave front. The output transition 35 focuses a radiated beam for a bore sight directional pattern as indicated by arrow 102 when all phase shifters or time delay settings are identical. Beam steering is then enabled by phase shifter/TTD 25 adjustment. Alternately, the phase shifter/TTD 25 settings can also collimate the wave front.

Figure 12:
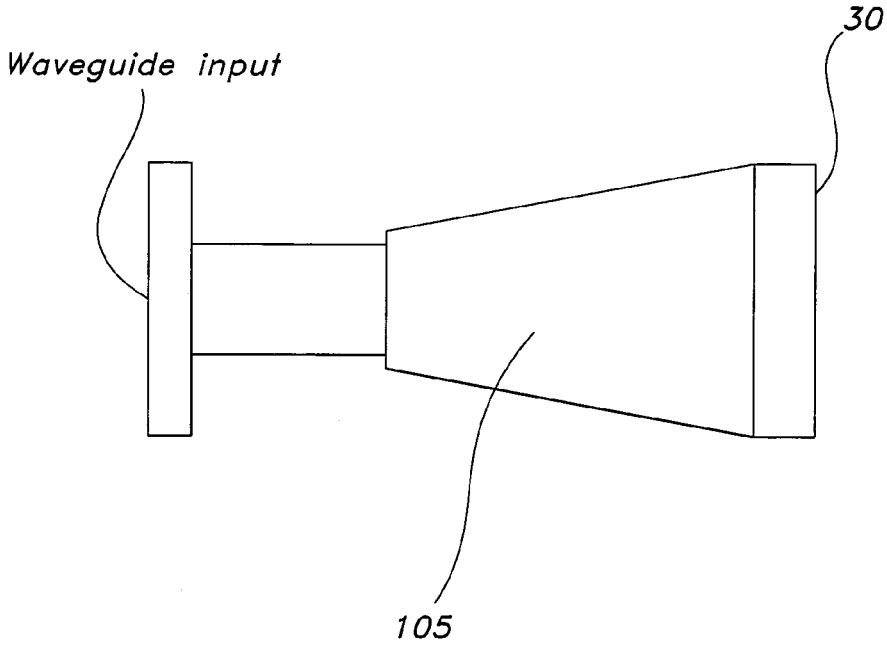
FIG. 12 shows a semi-constrained feed horn feeding the split waveguide structure.

The concept of FIG. 11 is also directly applicable for a semi-constrained horn feed 105 as shown in FIG. 12. FIG. 12 depicts a conceptual side view of the two-dimensional array of FIGS. 6 and 7 mounted to a semi-constrained horn 105. The electromagnetic field in the aperture of horn 105 illuminates the linear array 30 as shown. A direct connection occurs between the two-dimensional aperture and the horn feed 105.

It is believed that the split waveguide phased array antenna with integrated bias assembly of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A phased array antenna with a steered beam and having a plurality of split waveguide structures each of said plurality of split waveguide structures further comprising:

a printed circuit board substrate;

a planar transmission line-to-waveguide transition disposed on said printed circuit board substrate;

a split waveguide comprising two symmetrical portions said symmetrical portions being conductively joined to ground on opposite sides of the printed circuit board substrate; and a phase shifter/TTD device mounted on the planar transmission line-to-waveguide transition for steering the phased array antenna beam.

2. The phased array antenna of claim 1 further comprising a printed circuit board spine that is an extension of said printed circuit board substrate wherein a plurality of planar transmission line-to-waveguide transitions, a plurality of split waveguides, and a plurality of phase shifter/TDD devices are mounted thereon thereby forming a linear array of split waveguide structures.

3. The phased array antenna of claim 2 wherein a plurality of linear arrays of split waveguide structures is combined into a two-dimensional array.

4. The phased array antenna of claim 2 further comprising bias and control circuitry disposed on the printed circuit board spine for biasing and controlling the phase shifter/TTD devices within the split waveguide structures.

5. The phased array antenna of claim 2 further comprising a slotted waveguide feed feeding the linear array of split waveguide structures.

6. The phased array antenna of claim 3 further comprising:

a plurality of slotted waveguide feeds feeding the plurality of linear arrays of split waveguide structures; and a slotted waveguide feed manifold feeding the plurality of slotted waveguide feeds.

7. The phased array antenna of claim 2 further comprising an integrated feed manifold printed on or embedded within the printed circuit board spine and feeding the plurality of phase shifter/TTD devices.

8. The phased array antenna of claim 7 wherein a plurality of linear arrays of split waveguide feed structures is combined into a two-dimensional array.

9. The phased array antenna of claim 8 further comprising a perpendicular feed manifold connected to a plurality of integrated printed feed manifolds on the plurality of linear arrays of split waveguide feed structures to feed the two-dimensional array.

10. A phased array antenna comprising a plurality of linear arrays each of said plurality of linear arrays comprising:

a printed circuit board spine;

a plurality of split waveguides each of said plurality of split waveguides comprising two symmetrical portions said two symmetrical portions being conductively joined to ground on opposite sides of the printed circuit board spine;

a plurality of planar transmission line-to-waveguide transitions disposed on the printed circuit board spine within the plurality of split waveguides; and a plurality of phase shifter/TTD devices mounted on the circuit board spine within the plurality of split waveguides for steering the phased array antenna beam.

11. The phased array antenna of claim 10 further comprising bias and control circuitry disposed on the circuit board spine and for biasing and controlling the plurality of phase shifter/TTD devices.

12. The phased array antenna of claim 10 wherein the plurality of the linear arrays are combined into a two-dimensional array.

13. The phased array antenna of claim 10 further comprising a slotted waveguide feed feeding each of said linear arrays.

14. The phased array antenna of claim 12 further comprising:

a plurality of slotted waveguide feeds feeding the plurality of linear arrays combined into the two-dimensional array; and a slotted waveguide feed manifold feeding the plurality of slotted waveguide feeds.

15. The phased array antenna of claim 10 further comprising a printed feed manifold printed on the printed circuit board spine and feeding the plurality of phase shifter/TTD devices.

16. The phased array antenna of claim 15 wherein the plurality of the linear arrays are combined into a two-dimensional array.

17. The phased array antenna of claim 16 further comprising a perpendicular feed manifold connected to a plurality of printed feed manifolds on the printed circuit board spine to feed the two-dimensional array.

18. A phased array antenna with a steered beam and comprising a plurality of linear arrays each of said plurality of linear arrays having a printed wiring board spine with a plurality of split waveguide structures disposed thereon each of said plurality of split waveguide structures further comprising:

planar transmission line-to-waveguide transitions on the printed wiring board spine;

split waveguides comprising two symmetrical waveguide portions said symmetrical waveguide portions being joined to ground on opposite sides of the printed wiring board spine; and phase shifter/TTD devices mounted on the planar transmission line-to-waveguide transitions for steering the phased array antenna beam.

19. The phased array antenna of claim 18 wherein said symmetrical waveguide portions are metallurgically bonded to the ground on the printed wiring board spine.

20. The phased array antenna of claim 19 wherein vias through the printed wiring board spine provide side-to-side ground continuity to complete the waveguide from the symmetrical waveguide portions.

21. The phased array antenna of claim 18 wherein the waveguides having a plane of symmetry wherein said planar transmission line-to-waveguide transitions are mounted.

* * * * *